US006320927B1

(12) United States Patent
Endo et al.

(10) Patent No.: US 6,320,927 B1
(45) Date of Patent: Nov. 20, 2001

(54) ELECTRONIC COUNTER

(75) Inventors: Yoshihiro Endo; Yuichi Hoshino, both of Kodaira (JP)

(73) Assignee: Koyo Electronics Industries Co., LTD, Tokyo (JP)

( * ) Notice: Subject to any disclaimer, the term of this patent is extended or adjusted under 35 U.S.C. 154(b) by 0 days.

(21) Appl. No.: 09/552,222

(22) Filed: Apr. 19, 2000

(30) Foreign Application Priority Data

Feb. 21, 2000 (JP) ..... 12-042109

(51) Int. Cl.[7] ..... G06M 3/00
(52) U.S. Cl. ..... 377/26; 377/52
(58) Field of Search ..... 377/26, 45, 52

(56) References Cited

U.S. PATENT DOCUMENTS 4,795,984 * 1/1989 Janssen ..... 377/26
6,097,781 * 8/2000 Wright et al. ..... 377/26

* cited by examiner

*Primary Examiner*—Margaret R. Wambach
(74) *Attorney, Agent, or Firm*—Ladas & Parry

(57) ABSTRACT

It is an object of the present invention to make it possible to optionally configure various types of electronic counters. Therefore, the present invention is provided with a one-chip microcomputer 12 having a built-in ROM 13 and RAM 14 to write data corresponding to a variable on a program input through a communication port 10 and an interface 11 in the RAM 14.

5 Claims, 4 Drawing Sheets

1 Output when a counter value coincides with a set value

2 Output when a counter value is equal to or small than a set value

3 Output when a counter value is equal to or larger than a set value

ELECTRONIC COUNTER

BACKGROUND OF THE INVENTION

The present invention relates to an electronic counter which can be configured as a predetermined-type counter or timer in accordance with a request of a user each time.

Electronic counters include those having a single function and those having a multiple function. Some of electronic counters having a single function add input pulse strings and turn on an output when the added value reaches a value preset by a key switch. Moreover, there are some electronic counters allowing a value to be preset in two levels and counting methods include not only addition but also subtraction and addition-subtraction. Furthermore, an electronic counter having a multiple function has various functions such as a function for changing addition, subtraction, and addition-subtraction, a function for presetting a value in multiple levels, a function for changing pulse counting speeds, a function for changing output operations, and a timer-function for changing an input pulse to a time-string pulse. These functions are changed by each key switch.

The above electronic counters having a single function can be easily operated by users. However, because these electronic counters include various types, selection of them is troublesome for design and execution firms and therefore, management is troublesome at a job site. It is easy to select and manage electronic counters having a multiple function because they include less number of types compared to those having a single function. However, because they have various functions, function setting corresponding to a purpose is troublesome at a job side and moreover, an erroneous operation may be performed because an operation by a user is complex. Therefore, an electronic counter is desired which is suitable for a control system instead of adjusting the control system to the electronic counter or which can be easily operated though functions are complex as functions of an electronic counter are advanced.

The present invention is made to solve the above problems and its object is to provide an electronic counter whose functions can be easily set by an execution firm even if the functions are complex and moreover, which can be easily operated by a user.

SUMMARY OF THE INVENTION

An electronic counter of a first aspect of the present invention comprises an input circuit to which a pulse is input, an output circuit for outputting a signal, a communication port and an interface, a RAM, a ROM, and a CPU, wherein a program for realizing a counter or timer function is written in the ROM, and the CPU writes the data corresponding to a variable of the program input through the communication port and interface in the RAM, executes the program in accordance with the data, and thereby realizes the counter or timer function corresponding to the data. In case of the present invention, it is possible to change the counter or timer function only by changing the data in the RAM without changing the program in the ROM.

In case of an electronic counter of a second aspect of the present invention, a conditional program is written in a ROM, a CPU writes first data corresponding to a variable of a conditional program input through a communication port and an interface in a RAM, executes the conditional program in accordance with the first data, and thereby realizes a counter or timer function corresponding to the first data. In case of the present invention, a CPU writes first data corresponding to a variable of a conditional program input through a communication port or an interface in a RAM. Then, the CPU executes the conditional program in accordance with the first data. As a result, it is possible to realize a counter or timer function corresponding to the first data written in the RAM.

In case of an electronic counter of a third aspect of the present invention, a CPU writes second data corresponding to various variables including a counter or timer control constant input through a communication port and an interface in a RAM, executes a program in accordance with the second data, and thereby realizes a counter or timer function corresponding to the second data. In case of the present invention, because a program is executed in accordance with second data, it is possible to realize a counter or timer function corresponding to the second data.

In case of an electronic counter of a fourth aspect of the present invention, a changeover switch is included and a CPU uses input and output circuits as communication circuits instead of a communication port and an interface when the changeover switch is pressed.

In case of an electronic counter of a fifth aspect of the present invention, an input circuit dedicated to communication is used instead of a communication port and an interface, and a CPU uses an output circuit for output of communication when performing communication. In case of the present invention, a CPU uses an output circuit for outputting a signal as output of communication when performing communication by using an input circuit dedicated to communication.

BEST MODE FOR CARRYING OUT THE INVENTION

Embodiment 1

Figure 1:
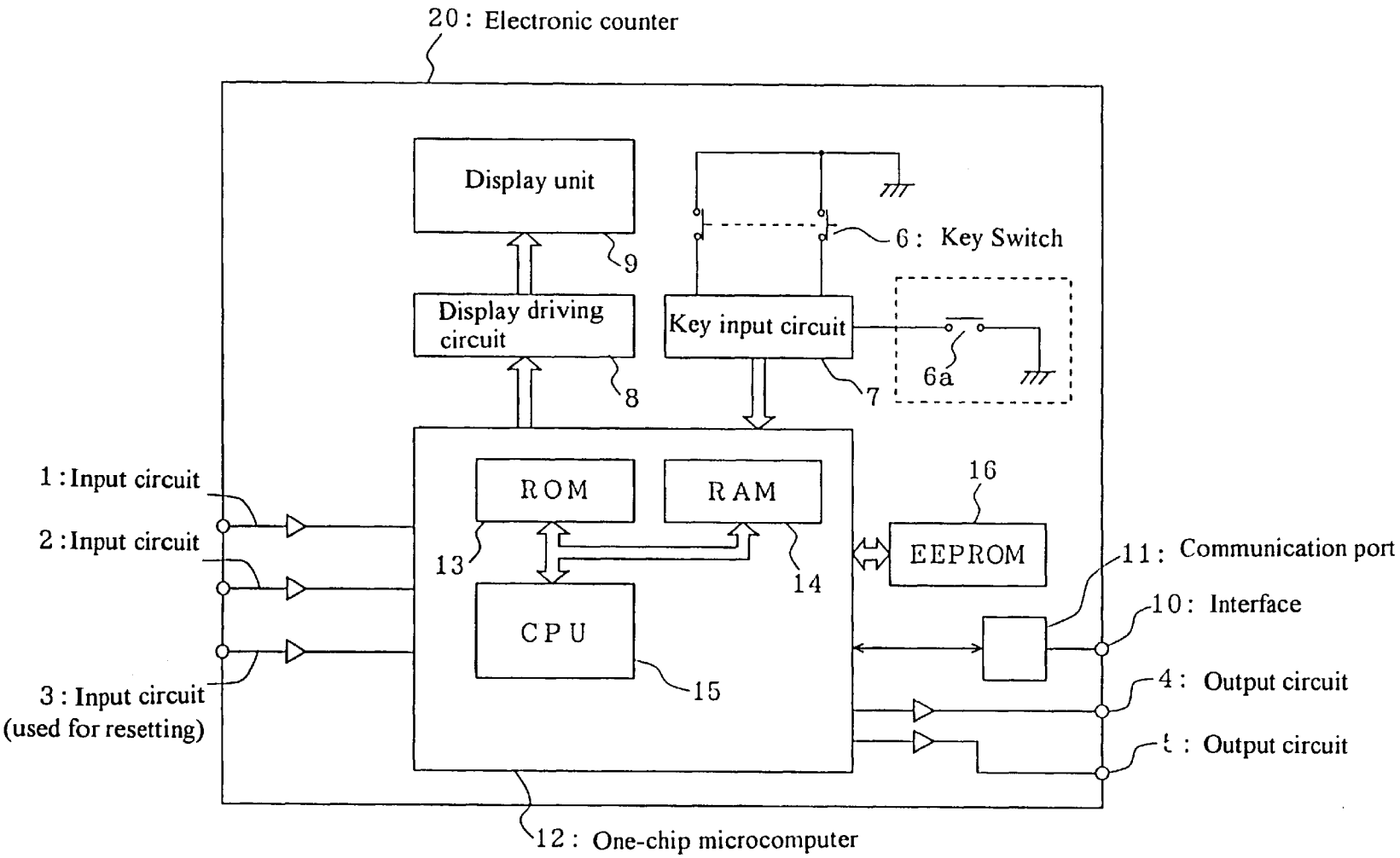
FIG. 1 is a block circuit diagram showing a configuration the electronic counter of an embodiment of the present invention.
Figure 2:
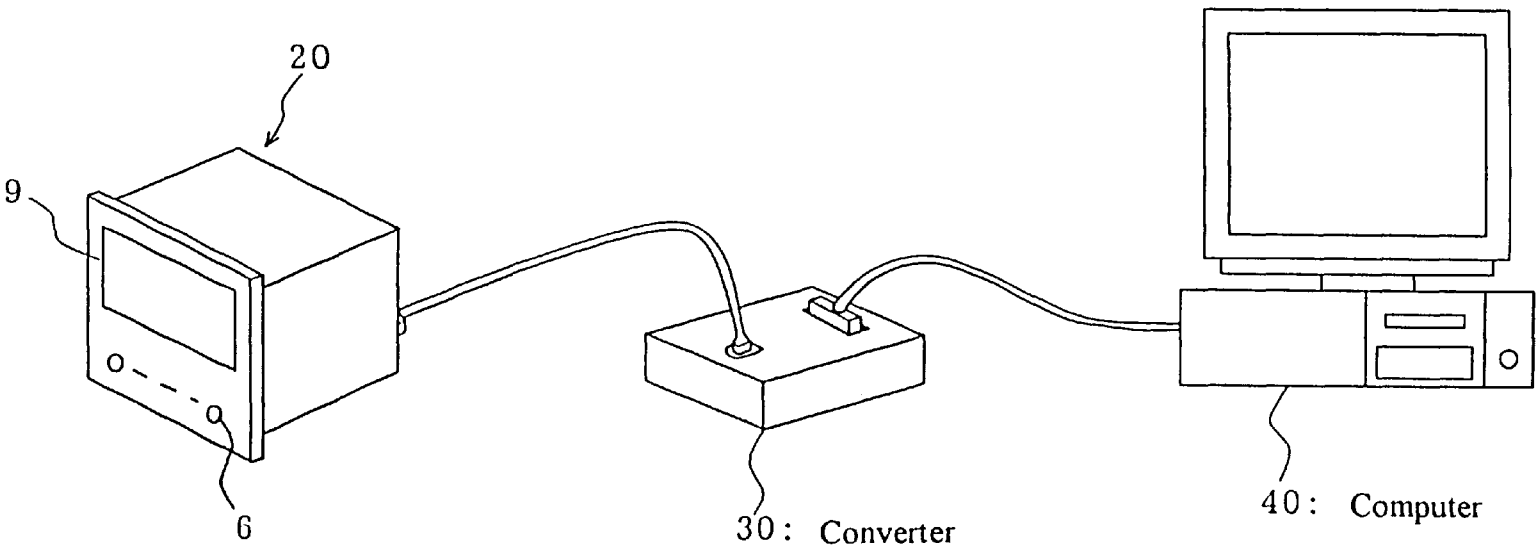
FIG. 2 is an illustration showing connection with a host system when writing a program in an electronic counter.

FIG. 1 is a block circuit diagram showing a configuration of the electronic counter of embodiment 1 of the present invention and FIG. 2 is an illustration showing connection with a host system when writing a program in an electronic counter.

In FIG. 1, symbols 1 and 2 denote input circuits for inputting a pulse output from a sensor or the like, 3 denotes an input circuit for inputting a reset pulse, 4 and 5 denote output circuits for turning on (or off) an output when a pulse counted value reaches a preset value (set value), 6 denotes a key switch for setting a preset value, display change, or resetting, and 7 denotes a key input circuit for outputting a signal to a one-chip microcomputer to be described later in accordance with an operation of the key switch 6. Symbol 8 denotes a display driving circuit for displaying a preset value or a pulse counted value on a display unit 9 (e.g. liquid-crystal display) in accordance with the control by the one-chip microcomputer, 10 denotes a communication port for connection with a computer 40 through a converter 30 as shown in FIG. 2, and 11 denotes an interface set between the one-chip microcomputer and the communication port 10.

Symbol 12 denotes the one-chip microcomputer (hereafter referred to as microcomputer) which is configured of a not-illustrated I/O port, a ROM 13 storing programs (a main program including conditional programs and subprograms for performing various processing) for realizing a counter or timer function of a predetermined format and a RAM transfer program, a RAM 14 for temporarily storing data corresponding to various variables including variables on the programs (variables on conditional programs) and a control constant or the like, and various types of data obtained under execution of a program, and a CPU 15 to be operated in accordance with a program instruction in the ROM 13 or data in the RAM 14 to realize a desired counter or timer function. Symbol 16 denotes, for example, an EEPROM connected to the microcomputer 12, in which various data in the RAM 14 are written when a power supply is cut off due to a trouble of a power system or the power supply is normally turned on or off.

The converter 30 converts a signal level output from the microcomputer 12 into a general signal form such as an electrical specification or connector specification for RS-422 or RS-485. It is also permitted to set the converter 30 in the electronic counter 20. The computer 40 transfers data corresponding to a variable on a program and data corresponding to various variables including a control constant (e.g. data for preset value or data for turning on/off the key switch 6) to the electronic counter 20 in order to configure a counter or timer having a format corresponding to a request of a user or an execution firm.

To write the above data generated by the computer 40 in the electronic counter 20, a write instruction is output and then data is transferred. When a write instruction is input to the electronic counter 20, the CPU 15 of the microcomputer 12 starts a RAM transfer program previously written in the ROM 13 to write the data sent from the computer 40 in the RAM 14.

Figure 3:
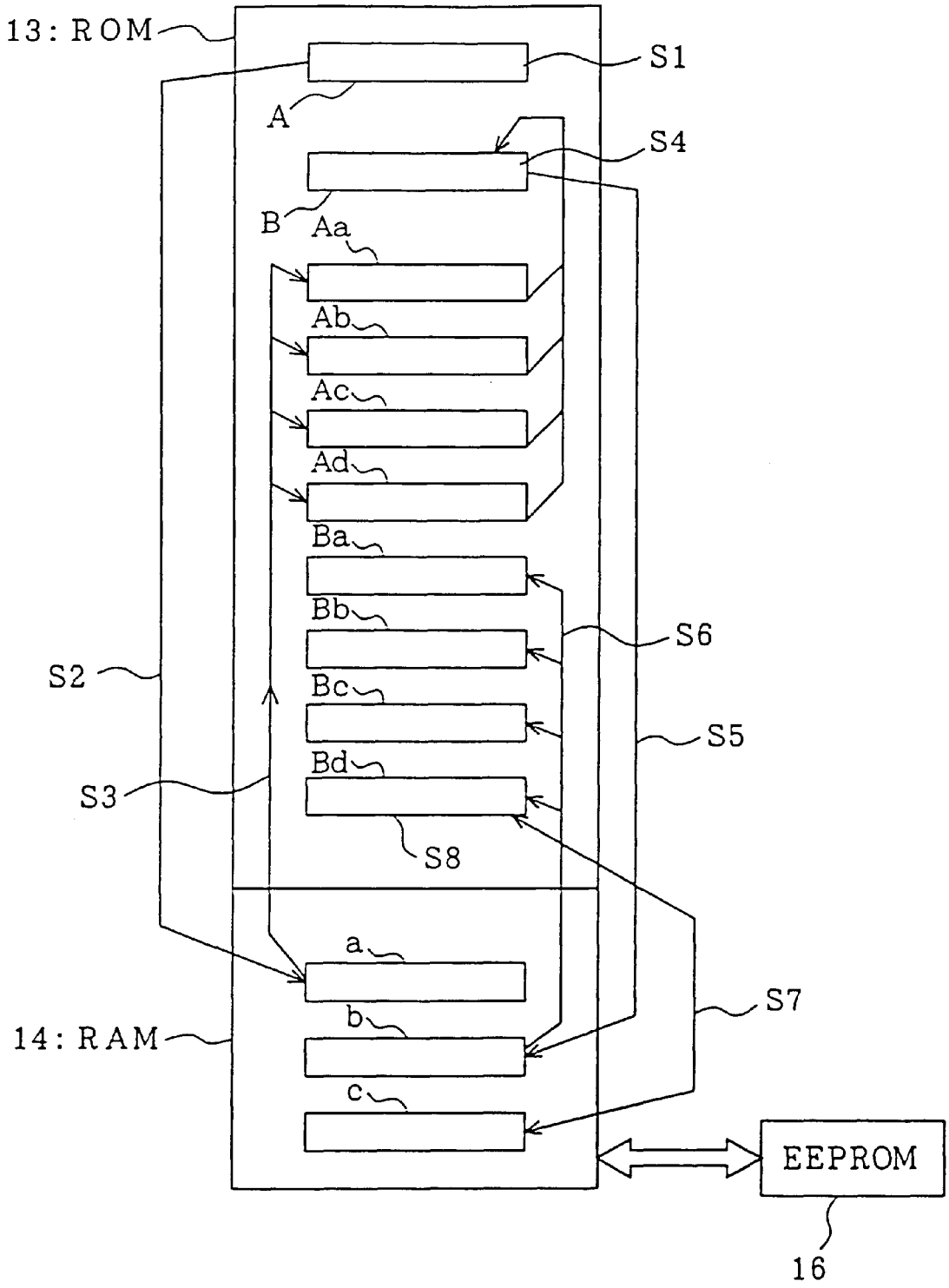
FIG. 3 is a block diagram showing the relation between a ROM and a RAM of the electronic counter in FIG. 1.

Then, the relation between program written in the ROM 13 and data written in the RAM 14 (data corresponding to a variable on a program) is described below. FIG. 3 is a block diagram showing the relation between the ROM 13 and the RAM 14 of the electronic counter in FIG. 1.

A program A for a pulse response and a program B for an output method, and subprograms Aa to Ad corresponding to the program A and subprograms Ba to Bd corresponding to the program B are written in the ROM 13 as conditional programs of a main program. The subprogram Aa processes a response of 10 Hz, the subprogram Ab processes a response of 1 kHz, the subprogram Ac processes a response of 5 kHz, and the subprogram Ad processes a highest response. Moreover, the subprogram Ba generates an output when a counter value coincides with a set value, the subprogram Bb generates an output when a counter value is equal to or smaller than a set value, the subprogram Bc generates an output when a counter value is equal to or larger than a set value, and the subprogram Bd generates an output under a specified condition. Furthermore, data corresponding to variables "a", "b", and "c" input from the computer 40 are written in the RAM 14. The variable "a" is data for selecting the subprograms Aa to Ad and the variable "b" is data for selecting the subprograms Ba to Bd. Furthermore, the variable "c" is a control constant. In this case, a specified time in the subprogram Bd is set.

Figure 4:
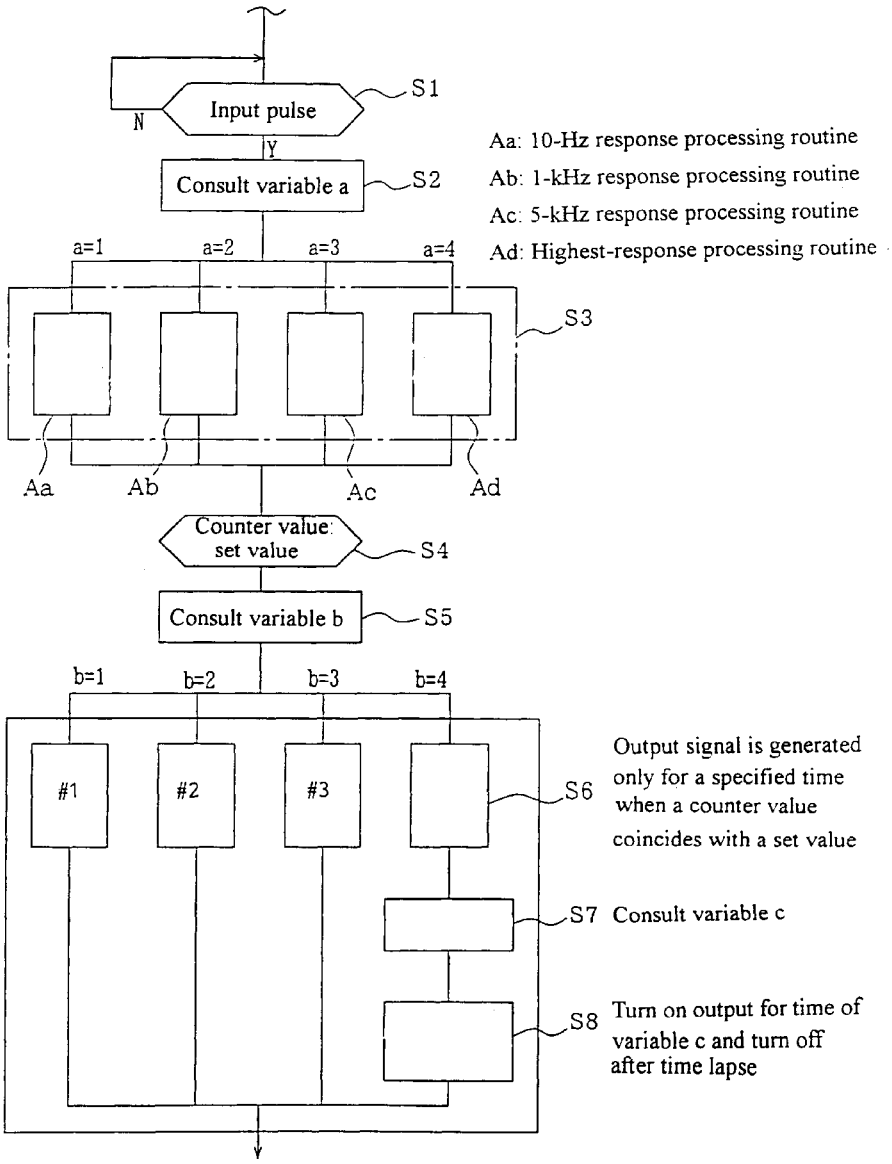
FIG. 4 is a flow chart showing operations in FIG. 3.

FIG. 4 is a flow chart showing the operations in FIG. 3. In this case, it is assumed that the CPU 15 starts processing the program A. To process the program A, the CPU 15 consults the content of the variable "a" in the RAM 14 (S2) when a pulse is input (S1). The CPU 15 determines the next processing routine in accordance with the content of the variable "a". That is, the subprogram Aa (10-Hz response processing routine) is started when the variable "a" is equal to 1, the subprogram Ab (1-kHz response processing routine) is started when the variable "a" is equal to 2, the subprogram Ac (5-kHz response processing routine) is started when the variable "a" is equal to 3, and the subprogram Ad (highest-response processing routine) is started when the variable "a" is equal to 4 (S3). In the above example, when the variable "a" is equal to 1, the subprogram Aa (10-Hz response processing routine) is started.

Then, when the above processings are completed, the main program is restarted. In the above example, the program B is started to compare a counter value with a set value as the processing content (S4). Then, the content of the variable "b" in the RAM 15 is consulted (S5) to determine the next processing routine in accordance with the content of the variable "b". For example, the subprogram Ba (output when a counter value coincides with a set value) is started for the variable "b=1", the subprogram Bb (output when a counter value is equal to or smaller than a set value) for "b=2", the subprogram Bc (output when a counter value is equal to or larger than a set value) is started for "b=3", and the subprogram Bd is started for "b=4" (S6). In this case, for "b=4", it is assumed that an output signal is generated only for a specified time when a counter value coincides with a set value, the variable "c" in the RAM 14 is consulted for the time (S7), an output signal is transmitted only for the specified time, and generation of an output signal is stopped when the time passes (S8).

For the above embodiment, a case is described in which the variables "a" and "b" are used to specify a subprogram. However, when the content of the subprogram is incorporated into a main program, a step jumps to the address of a program concerned in accordance with variables "a" and "b" on the program. A variable "c" is not restricted to the above example. For example, it is possible to use the above set values and the like as variables of various control data and write the data corresponding to the variables in the RAM 14.

Thus, the electronic counter 20 in which the data corresponding to a variable on a program is written in the RAM 14 is able to realize a counter or timer function having various functions by properly changing the data. Therefore, it is possible to easily configure the electronic counter 20 corresponding to a purpose and provide the electronic counter 20 suitable for a control system. Moreover, when compared with a conventional electronic counter having a multiple function, operations for setting functions become easy and operations by a user are simplified. Therefore, an advantage is obtained that an erroneous operation is prevented.

Embodiment 2

Embodiment 2 makes it possible to appropriate an input circuit and an output circuit having been used for a counter function for communication. Hereafter, the embodiment 2 is described by referring to FIG. 1. Though a communication port 10 and an interface 11 are used in FIG. 1, it is assumed that an electronic counter 20 not provided with the port 10 and interface 11 is used and a program for realizing a counter or timer function corresponding to a purpose is stored in a ROM 13.

In case of the embodiment 2, a changeover switch **6*a* is connected to a key input circuit 7. When the changeover switch 6*a* is pressed, a CPU 15 is changed so as to synchronize with a communication rate. For example, when an input circuit 1 and an output circuit 4 are connected to a computer 40 and data (a variable or variables) for changing functions is received from the computer, the CPU 15 writes the data in a RAM 14. When an instruction for reading the data (a variable or variables) written in the RAM 14 is output, the CPU 15 transmits the data to the computer 40 through the output circuit 4**.

Thus, when the changeover switch 6*a* is pressed, it is possible to perform communication with the computer 40 and rewrite or read data (a variable or variables). Therefore, it is possible to substantially change a counter or timer function. Moreover, because the input circuit 1 and output circuit 4 are used for connection with the computer 40, it is possible to provide an inexpensive electronic counter without complicating a circuit configuration. Moreover, because functions are changed by variables, an advantage is obtained that operations by an execution firm or user are simplified.

Though communication with the computer 40 can be made by the changeover switch 6*a*, it is also permitted to use an instruction of a program key for change. Moreover, in case of the embodiment 2, communication with the computer 40 can be made by using the input circuit 1 and the output circuit 4. However, it is also permitted to provide an input circuit dedicated to communication for the electronic counter 20 so that the data (a variable or variables) in the RAM 14 can be rewritten or read by using the input circuit and either of the output circuits 4 and 5. In this case, when an instruction for rewrite or read is input through an input circuit dedicated to communication, the CPU 15 is changed so as to synchronize with a communication rate and performs data communication with the computer 40. Output to the computer 40 is performed through the output circuit 4 or 5 connected with the computer 40.

An electronic counter provided with an input circuit dedicated to communication also has an advantage of making it possible to provide an electronic counter capable of changing a counter or timer function by changing the data (a variable or variables) in the RAM 14 as described above.

According to the present invention having the above configuration, it is possible to write data corresponding to a variable on a program in a RAM, realize a counter or timer function corresponding to a purpose, and provide an electronic counter suitable for a control system. Moreover, when compared with a conventional electronic counter having a multiple function, advantages are obtained that function setting operations become easy and moreover, an erroneous operation is prevented because operations by a user are simplified.

Moreover, as a result of writing first data corresponding to a variable on a conditional program in a RAM and executing the conditional program in accordance with the first data so as to realize a counter or timer function corresponding to first data, advantages are obtained that a counter or timer function can be changed only by changing the first data, function setting operations become easy, and an erroneous operation is prevented because operations by a user are simplified.

Moreover, as a result of writing second data corresponding to various variables including a counter or timer control constant in a RAM so as to execute a program for the second data, advantages are obtained that a counter or timer function corresponding to the second data can be realized, function setting operations become easy, and an erroneous operation is prevented because operations by a user are simplified.

Furthermore, as a result of using an input circuit for receiving a pulse and an output circuit for outputting a signal as communication circuits so that data can be written in or read out of a RAM when a changeover switch is pressed, it is possible to change a counter or timer function. Moreover, as a result of using an input circuit and an output circuit for connection with an external unit, advantages are obtained that it is possible to provide an inexpensive electronic counter without complicating a circuit configuration and operations by an execution firm or a user are simplified because functions are changed by a program.

Furthermore, as a result of using an output circuit for outputting a signal for output of communication when performing communication by using an input circuit dedicated to communication, an advantage is obtained that it is possible to provide an electronic counter capable of changing a counter or timer function in accordance with the data written in a RAM.

We claim:

1. An electronic counter, comprising:

an input circuit to which a pulse is input; an output circuit for outputting a signal; a communication port and an interface; a RAM; a ROM; and a CPU, wherein:

a program for realizing a counter or timer function is written in the ROM; and the CPU writes the data corresponding to a variable on the program input through the communication port and interface in the RAM to realize a counter or timer function corresponding to the data by executing the program in accordance with the data.

2. The electronic counter according to claim 1, wherein:

a conditional program is written in the ROM; and the CPU writes first data corresponding to a variable on the conditional program input through the communication port and interface in the RAM and executes the conditional program in accordance with the first data to realize a counter or timer function corresponding to the first data.

3. The electronic counter according to claim 1, wherein the CPU writes second data corresponding to various variables including a counter or timer control constant input through the communication port and interface in the RAM and executes the program in accordance with the second data to realize a counter or timer function corresponding to the second data.

4. The electronic counter according to claim 1, further comprising a changeover switch, wherein the CPU uses the input and output circuits as communication circuits instead of the communication port and interface when the changeover switch is pressed.

5. The electronic counter according to claim 1, wherein:

an input circuit dedicated to communication is used instead of the communication port and the interface; and the CPU uses the output circuit for output of communication when performing communication.

* * * * *